United States Patent [19]

Germer

[11] 4,355,582

[45] Oct. 26, 1982

[54] RAILWAY CAR TILT CONTROL SYSTEM

[75] Inventor: John A. Germer, Doylestown, Pa.

[73] Assignee: The Budd Company, Troy, Mich.

[21] Appl. No.: 165,948

[22] Filed: Jul. 3, 1980

[51] Int. Cl.[3] ..... B61F 3/08; B61F 5/24; B61F 5/50

[52] U.S. Cl. ..... 105/164; 105/182 R; 105/199 A; 105/199 R; 105/210

[58] Field of Search ..... 105/164, 199 R, 182 R, 105/199 A, 210

[56] References Cited

U.S. PATENT DOCUMENTS

| | | | |
|---|---|---|---|
| 3,683,818 | 8/1972 | Meir et al. | 105/164 |
| 3,704,670 | 12/1972 | Dobson et al. | 105/199 R X |
| 3,789,769 | 2/1974 | Strohmer et al. | 105/164 |
| 3,918,369 | 11/1975 | Kitaoka et al. | 105/164 |
| 4,271,765 | 6/1981 | Dickhart | 105/199 R X |

*Primary Examiner*—Joseph F. Peters, Jr.
*Assistant Examiner*—Howard Beltran
*Attorney, Agent, or Firm*—Herman Foster

[57] ABSTRACT

A tilt system for a railway car includes mechanism for tilting the car only when lateral acceleration forces exceed preselected minimum levels and to limit the amount of tilting of the car.

10 Claims, 12 Drawing Figures

RAILWAY CAR TILT CONTROL SYSTEM

BACKGROUND OF THE INVENTION

It is well known that when railway cars go around curves at relatively high speeds that lateral forces are produced in the car which cause passenger discomfort. Generally higher speeds are possible if the car body is tilted to reduce the lateral curving accelerations experienced by the passengers.

In designing railway track systems, the various curves are considered. When possible, the tracks are elevated at sharp turns to provide tilting of the cars as they make the turns. The amount of tilting desirable in railway cars is dependent upon the speed of the cars and the radius of the track at the curves. Generally, the amount of tilting should be proportional to the square of the speed and inversely proportional to the radius of the curved involved. In designing the tracks at curves, the outer track is made higher than the inner track to bank the cars into the curve. Placing one track higher than the other is generally referred to as superelevation.

A major limitation in any effort to improve a train schedule is the speed limit on curves. For well maintained tracks, the curving speed is set by the tolerance the passengers have for the lateral acceleration. This lateral acceleration is proportional to the square of the speed and inversely proportional to the curvature (radius) of the track. Lateral acceleration can be compensated by building the outer track higher than the inner track (superelevation, that is, to bank the car in the curve).

It is generally impractical to improve curving speed by straightening the track or increasing the superelevation. Another method of keeping the lateral forces in the passengers low, is to tilt the car on the track, that is, to bank the car body in addition to banking the track.

There have been many types of tilt methods proposed and some in service. These methods can be catagorized as proportional systems, both passive and active.

In a passive system, the car body is suspended at a point above the center of gravity. The body then tilts into the curve in response to a lateral acceleration. This system may require a portion of the tilt mechanism to be within the passenger compartment, and therefore, reduces the revenue seats available and results in considerable increase in car structure.

In the active type control, the car body tilt would constantly be adjusted to minimize the effect of lateral acceleration on the passengers. The car body would tilt in such a way that the passengers would barely detect that they were in a curve until the tilt system has reached its maximum angle. If the car exceeds this balance speed, the excess speed will be felt as a lateral acceleration. Normally, an excess speed equivalent to 3 inches cant deficiency (0.05 g's) is acceptable. This system requires a considerable amount of feedback signal processing and control.

One of the problems involving tilting of the car body is that when a car body is tilted relative to the track, it approaches the clearance line as established by the railroad. The closer the car body is built to the clearance line, the less the tilt angle before the body penetrates the clearance line. The clearance line is a composite of many space restrictions. For example, clearances for tunnels, station platforms and yard equipment are included in the clearance line. Because of the clearance requirements it is important that the degrees of tilting be limited.

It is apparent that compromises must be made between passenger discomfort and the amount of tilting that can be used in a rail car going around curves. Normally, an excess speed equivalent to 3 inches cant deficiency (0.05 g's) is acceptable to passengers. Consequently, it is desirable to have a tilt system in a railway car which starts to tilt prior to excessive passenger discomfort and at the same time limit the degrees of tilting to stay within the clearance requirements.

An important consideration in designing any tilt system within a car is that it must be fail safe. By this is meant that if there is any failure of the tilting system within the car that the car assume the position that it would normally have in the absence of the tilt system.

Generally, fixed stop members are provided between the main car body and the truck to limit the downward vertical movements of the car when it is travelling at high speed and encounters conditions which cause it to tend to bounce. The stop members are provided to prevent the car from hitting and damaging elements located beneath the car or on the truck. The presence of such fixed stop members tend to interfere with the design of tilting systems, but at the same time, their presence are important in the design of most conventional railway cars.

OBJECTS OF THE INVENTION

It is an object of this invention to provide an improved tilting system for a railway car.

It is a further object of this invention to provide an improved tilting system for a railway car which becomes selectively operative before the levels of passenger discomfort is reached while still limiting the degree of tilting within clearance requirements.

It is still a further object of this invention to provide an improved tilting system for a railway car in which none of the tilting members are inside of the car.

It is still a further object of this invention to provide an improved tilting system for a railway car which permits the use of stop members which do not interfere with the operation of the tilting system.

BRIEF SUMMARY OF THE INVENTION

In accordance with the present invention, mechanisms are provided to tilt a car body of a railway car in response to lateral acceleration forces. An actuator is actuated when acceleration forces exceeding predetermined minimum levels are detected with the degree of tilting of the car body being limited.

Other objects and advantages of the present invention will be apparent and suggest themselves to those skilled in the art, from a reading of the following specification and claims, taken in conjunction with the accompanying drawings, in which:

DETAILED DESCRIPTION OF THE PREFERRED EMBODIMENTS

One type of mechanical system of the present invention may be used is described in U.S. Pat. No. 4,271,765 entitled "A Tilt System for a Railway Car", and assigned to the same assignee as the present invention.

In this application, a system for a railway car body supported on a truck is described. A roll bar structure comprising two rotatable members are attached to the car body on the bottom of both sides between body and the bolster. A pair of lever arms connect the ends of the two rotatable members to link elements on the bolster. The rotatable members maybe selectively rotated in opposite directions. Rotation of the rotatable members move the lever arms and links to force the car body to tilt laterally with respect to the bolster, with the angle of tilt being programmable or controllable.

While it is understood the tilting arrangement described in the application is merely an example of one type of system with which the present invention may be used, the main features of this arrangement are described briefly.

Figure 1:
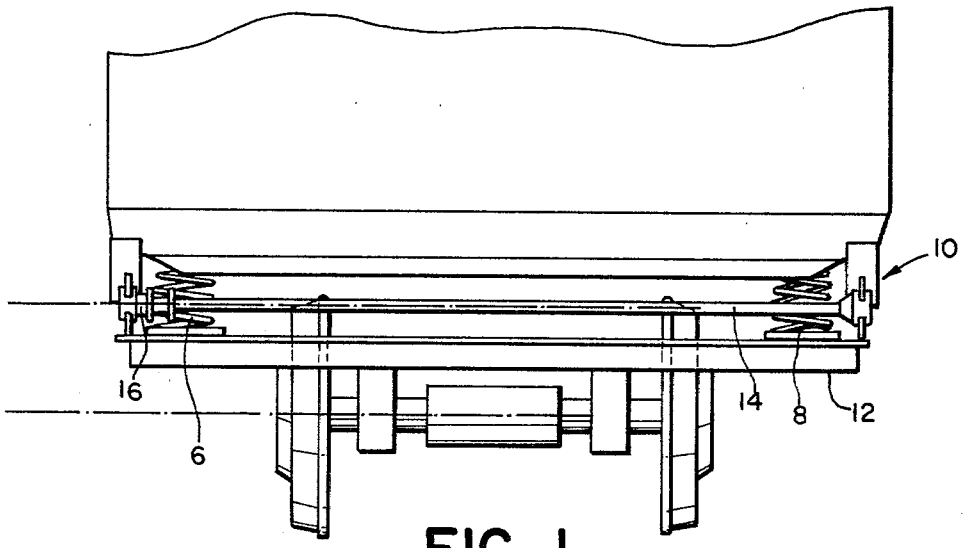
FIG. 1 is an end view of a railway car illustrating the car in an untilted position.
Figure 2:
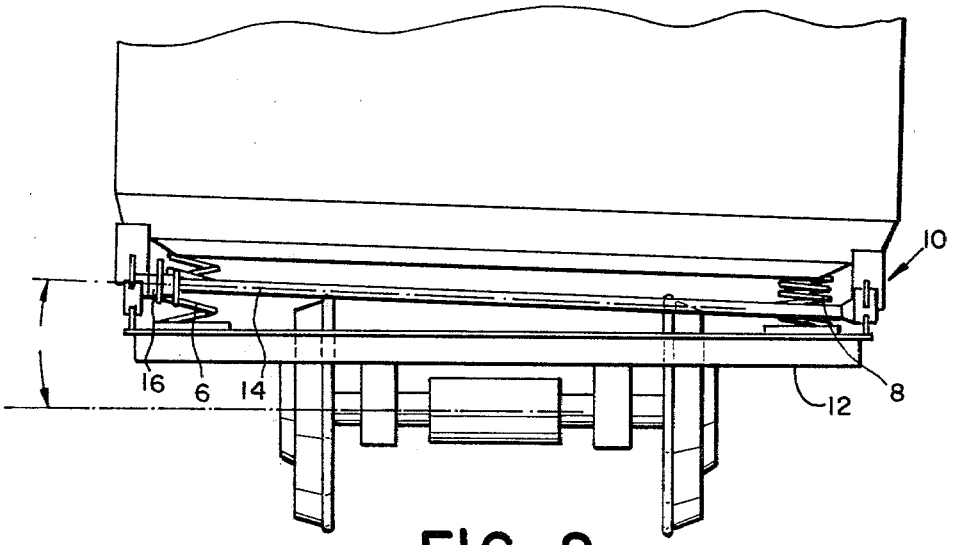
FIG. 2 is an end view of the car illustrating the car of FIG. 1 in a tilted position.

FIG. 1 illustrates an end view of a railway car 10 when no tilting operation is applied. FIG. 2 illustrates an end view of the car in which a tilting operation is applied with the left side of the car moving up and the right side of the car moving down. A truck 12 including springs 6 and 8 support the car 10. Rotatable members 14 and 16 are provided for tilting and are described in connection with FIGS. 2 and 3.

Figure 3:
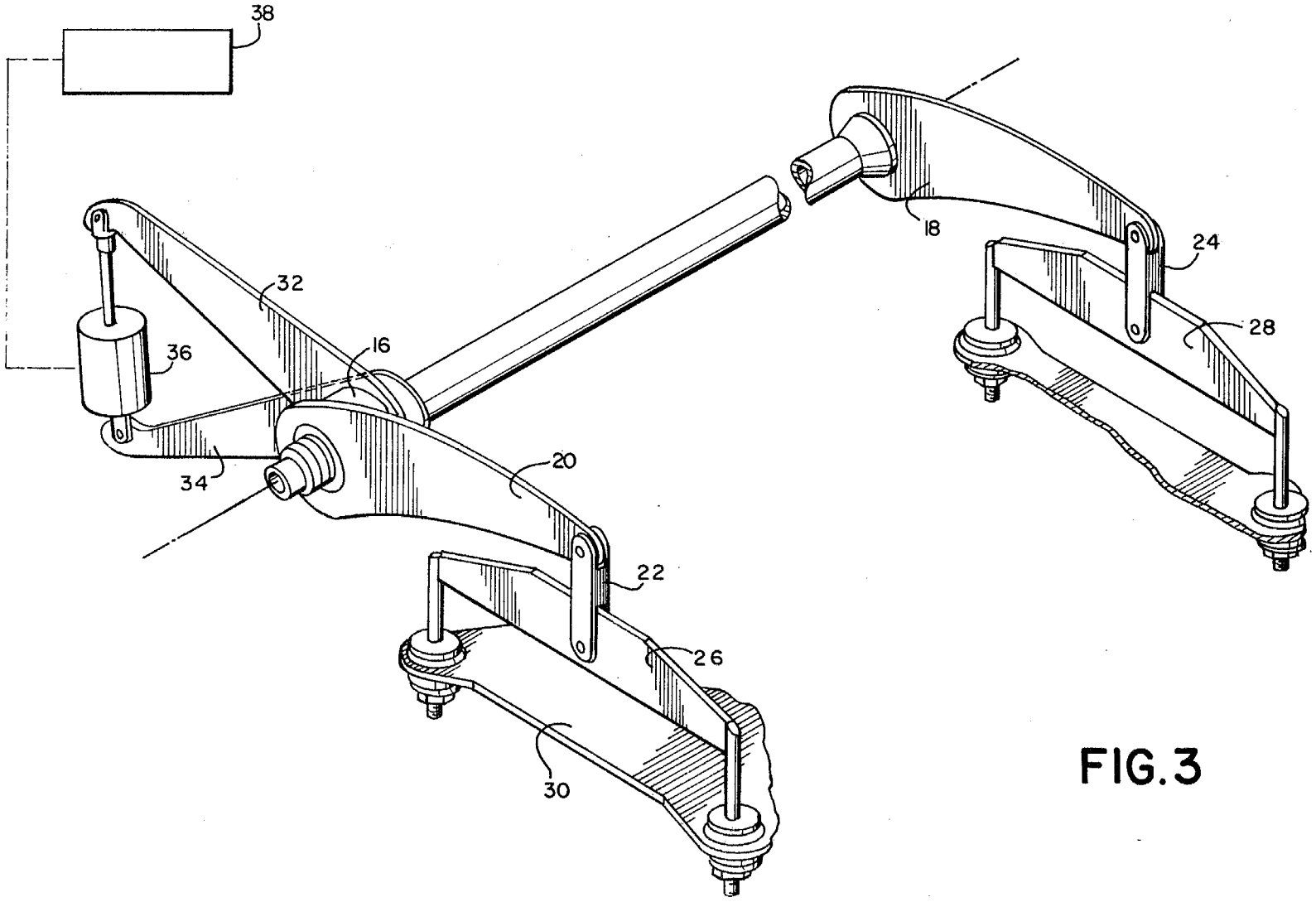
FIG. 3 is an isometric view of a tilt system in an untilted position which maybe used with the present invention.
Figure 4:
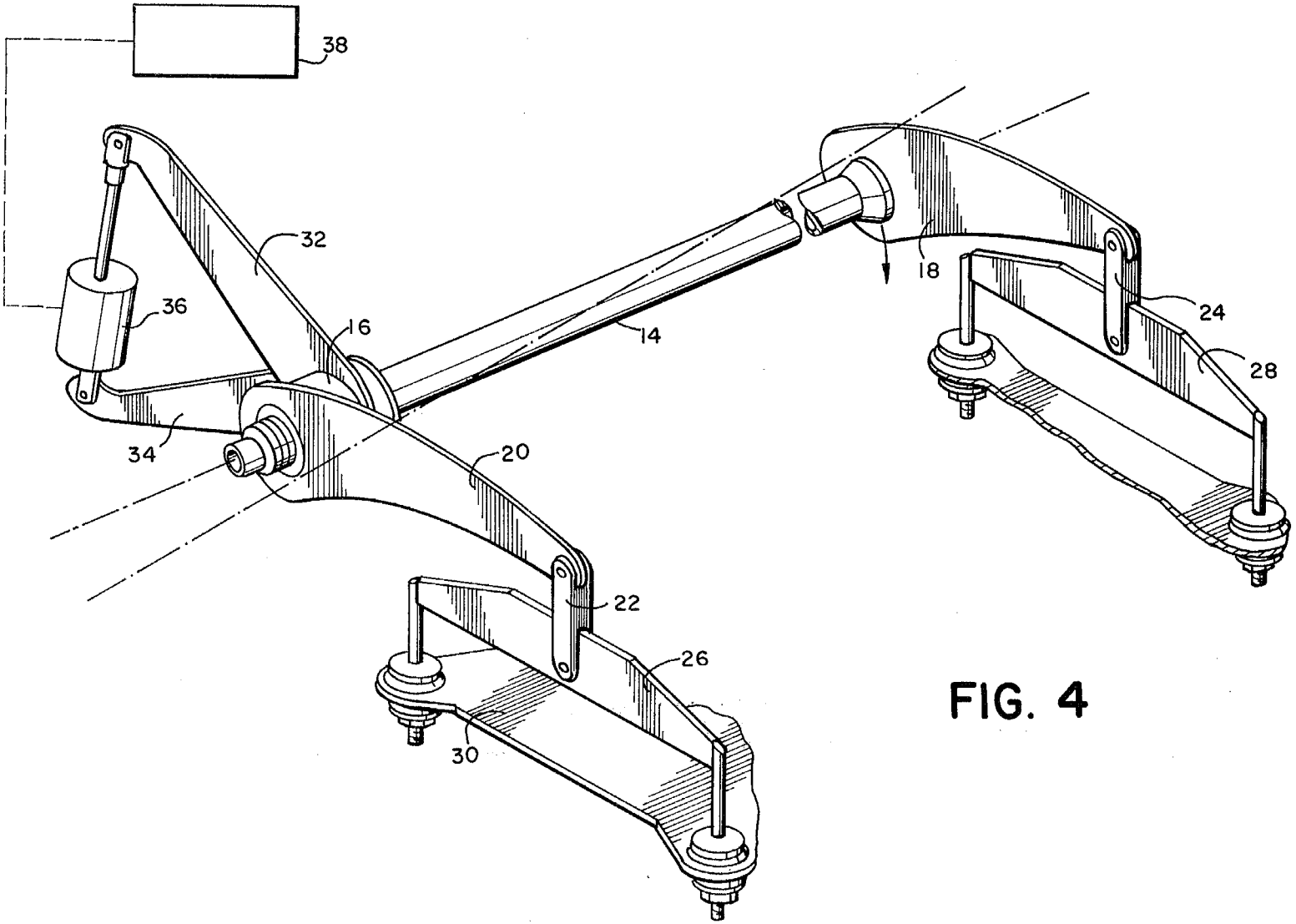
FIG. 4 is an isometric view similar to FIG. 3 illustrating the system in a tilted position.

Referring to FIGS. 3 and 4, the pair of rotatable members 14 and 16 are secured to rotate in brackets (not illustrated) which are fixably mounted to the car body 10. The ends of the rotatable members 14 and 16 are free to rotate within the brackets.

The ends of the members 14 and 16 are connected to lever arms 18 and 20, respectively. The lever arms 18 and 20 are adapted to move or be pivoted with the ends of the rotatable members 14 and 16 during a tilting operation. The other ends of the lever arms 18 and 20 are connected to a pair of links 24 and 22. The links 22 and 24 are pivotally connected between the lever arms 18 and 20 and steel plates 26 and 28. The steel plates are fixedly secured to the bolster 30 of the truck by welding or suitable bolts and nuts. Because the steel plate 26 is fixed to the bolster 30, the link 22 may in effect be considered as being connected directly to the bolster 30. This is also true of the link 24. Consequently, when the lever arms 18 and 20 are rotated, one end of the lever arms will tend to stay fixed with respect to the car 10 and the other end will tend to move up or down, depending upon the tilting direction, to transmit force through the links 22 and 24 to force the car body 10 up or down with respect to the bolster 30. The system is designed to move the lever arms 18 and 20 in opposite directions so that the associated links 22 and 24 will tend to permit the sides of the car 10 to be tilted up or down in opposite directions.

A pair of arms 32 and 34 are fixedly secured to the members 14 and 16 respectively, with the detailed connections not being illustrated. The rotatable member 14 is connected to be rotated by the arm 34 and the rotatable member 16 is connected to be rotated by the arm 32.

In the aforementioned copending application, a ball screw actuator was connected between the free ends of the arms 32 and 34. The ball screw actuator was adapted to expand or contract in accordance with the amount of tilt to be accomplished. In the present invention, a different type actuator 36 is disposed to spread the arms 32 and 34 or to bring them closer together, in accordance with a signal from a source 38. This is described in connection with FIG. 8.

Figure 5:
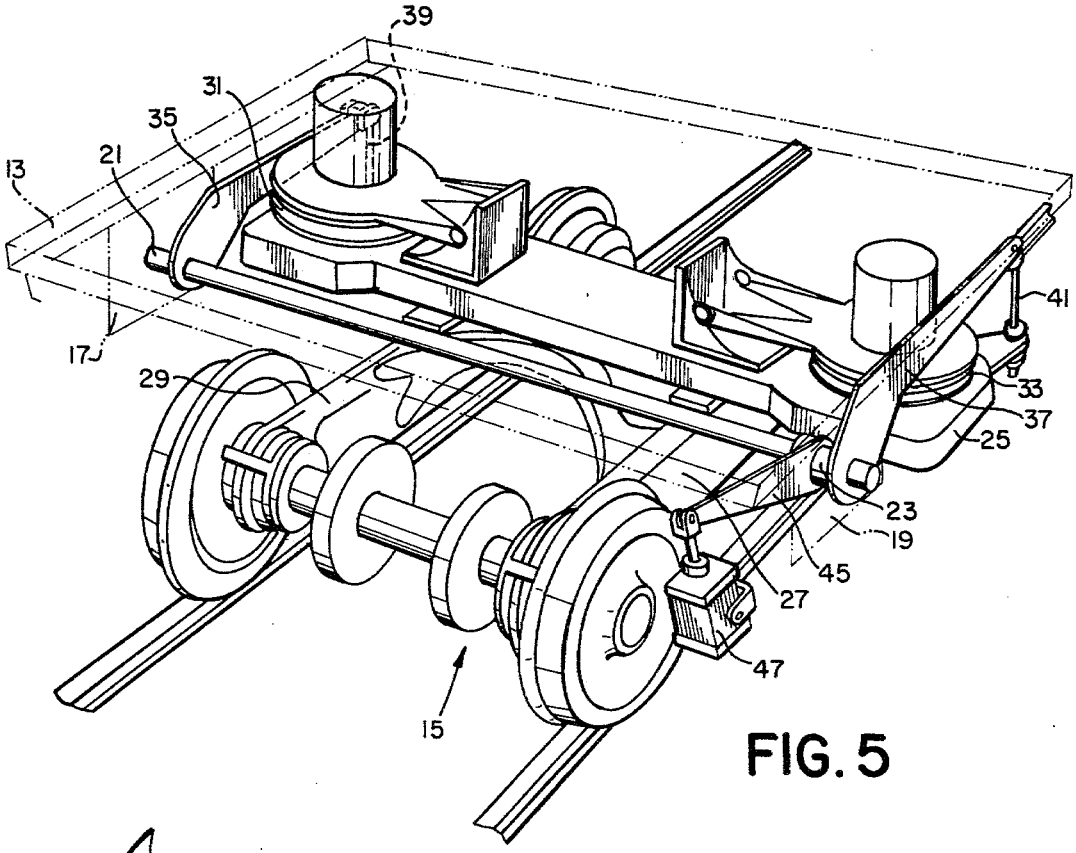
FIGS. 5, 6 and 7 are isometric views illustrating a tilting system in accordance with the present invention.
Figure 6:
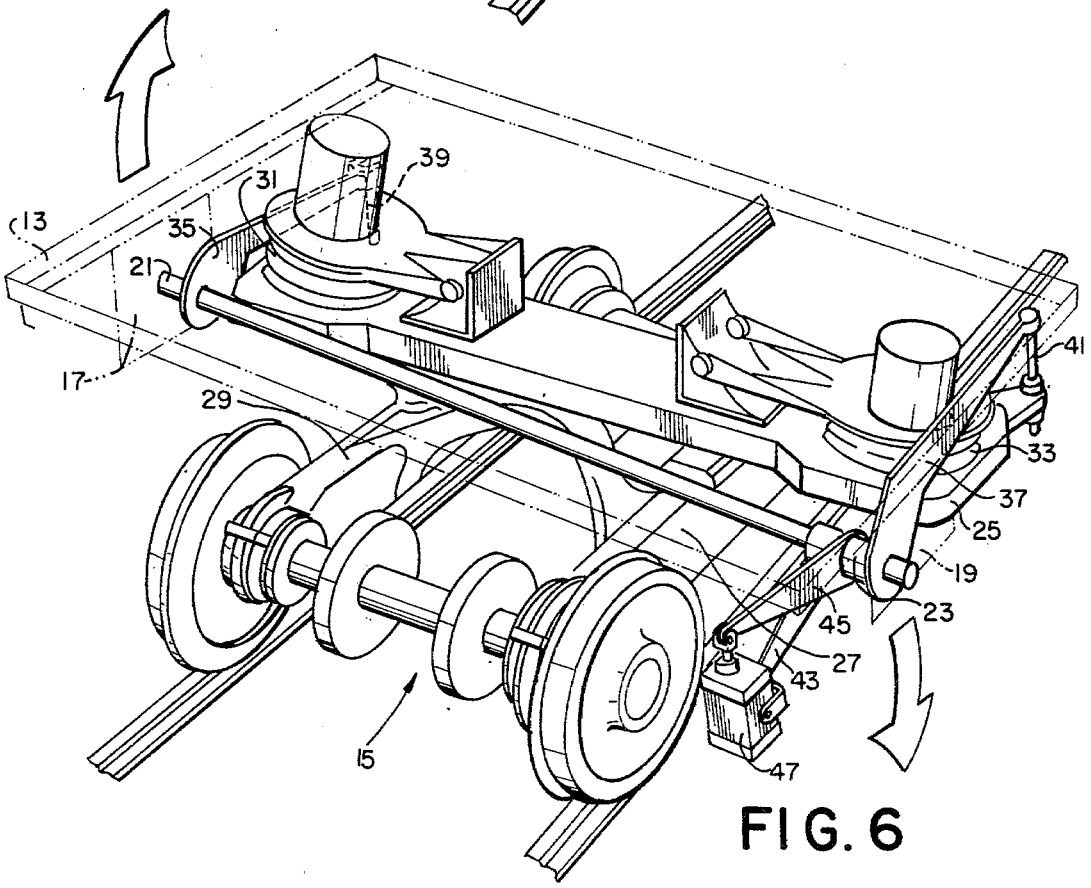
Figure 7:
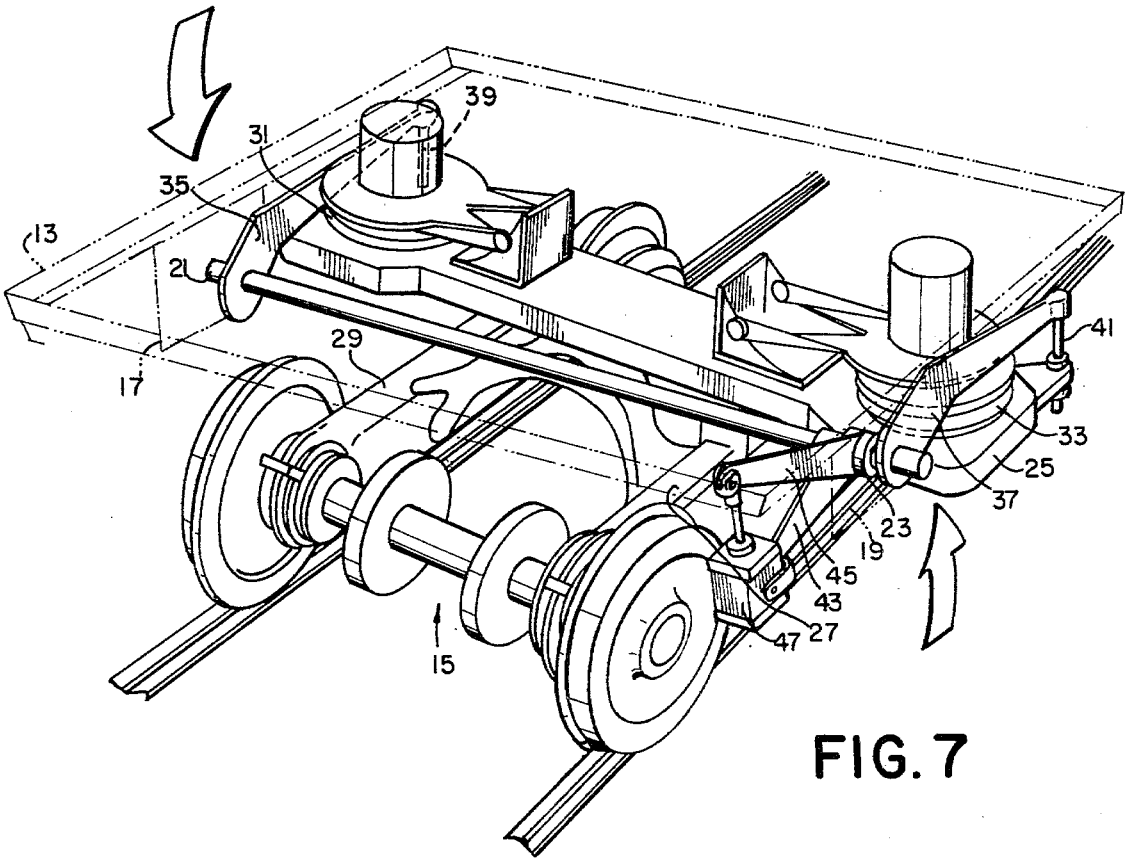

Referring to FIGS. 5, 6 and 7, many of the elements illustrated are similar to those illustrated in FIGS. 1-4. However to avoid confusion, different reference numerals will be used. FIGS. 5, 6 and 7 illustrate the direction of tilting of the car body with respect to the truck. FIG. 5 illustrates a "no tilt" or neutral position. FIG. 6 illustrates a condition in which the left side of the car body is tilted upwardly and the right side is tilted downwardly. FIG. 7 illustrates a condition opposite to that of FIG. 6 where the right side of the car body is tilted upwardly and the left side is tilted downwardly.

The car body 13 is carried by a truck 15, which includes the various wheel-axle assembles, brake mechanisms and other parts found in conventional trucks. These parts will not be referred to or described in detail because they are well known and only incidentally related to the invention.

The car body 13 includes downwardly extending plates 17 and 19 fixed thereto. The plates 17 and 19 receive the rotatable members 21 and 23 therein which operate in a manner described in connection with rotatable members 14 and 16 in FIGS. 3 and 4.

The truck 15 includes a bolster fixed to side frames 27 and 29. A pair of springs 31 and 33 are secured to the bolster 25 and supports the car body 13.

One end of each of lever arms 35 and 37 are connected to move with the rotatable members 21 and 23 during a tilting operation. The other ends of the lever arms 35 and 37 are connected to links 39 and 41, which are fixed to the bolster 25. When the lever arms 35 and 37 are rotated, one of each of their ends will remain fixed with respect to the car body 13 with the free ends moving up or down depending upon the direction of tilt during a tilting operation.

A pair of arms 43 and 45 are fixedly secured to the rotatable members 21 and 23, respectively, with the detailed connections not being illustrated. An actuator 47 (similar to the actuator 36 in FIGS. 3 and 4) is connected between the free ends of the arms 43 and 45. Operation of the actuator 47 will cause the arms 43 and 45 to spread further apart or come closer together. The operation of the mechanical components illustrated regarding the tilting operation apart from the actuator 47 is similar to that described in the aforementioned copending application.

Figure 8:
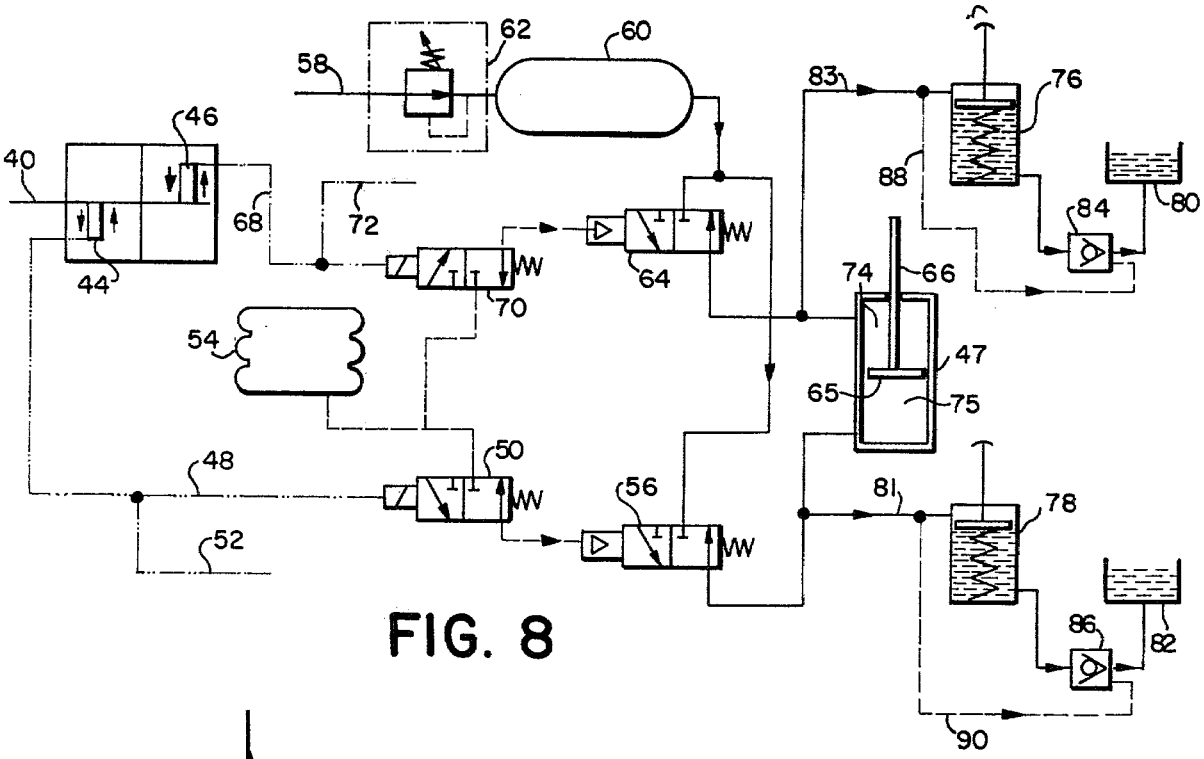
FIG. 8 is a schematic diagram illustrating a system for selectively actuating a mechanical tilting system, in accordance with the present invention.

Referring to FIG. 8, the system for activating the actuator 36 or actuator 47 of FIGS. 5, 6 and 7 is illustrated. Basically the system is designed to provide tilting of a car body in either direction when the lateral acceleration forces exceed some predetermined level, as illustrated in FIG. 6 or 7. Tilting of the car body is limited to some predetermined number of degrees.

The lateral acceleration forces are preferably detected on the truck below the car body. A sensor such as an accelerometer Model 115 of Setra Systems, Inc., Natick, Mass., or equivalent which detects the acceleration and together with an signal conditioning amplifier provides an electrical signal at predetermined lateral accelerations, for example, approximately 0.04 g. The lateral acceleration forces are detected and electrical signals from an accelerometer on the truck, for example, are applied to a line 40 which in turn is applied to a pair of signal processors 44 and 46 where they are filtered and which produce an output signal only when the lateral acceleration forces exceeds the predetermined lateral acceleration of 0.04 g.

Depending upon which of the signal processors 44 or 46 is activated, the car body 13 (FIG. 5) will be tilted in one direction or the other by the application of pressure to an upper chamber 74 or lower chamber 75 of the actuator 47, as will be described. First a situation in which the signal processor 44 is actuated.

When the signal processor 44 is actuated, an electrical signal is developed in a line 48, which is also applied to a line 52 connected to a trailing truck. The signal at the line 48 is applied to a valve 50 to shift the valve to permit pressurized air to pass from air spring or reservoir 54, through the valve 50 to the pilot on valve 56.

Air from the main reservoir (not illustrated) is supplied through line 58 to the pressure regulator 62 which supplies air to the reservoir 60, which may be disposed in each of the cars. Pressure in the reservoir 60 is sufficient to provide the forces necessary for tilting the car body. When the valve 56 is actuated, air from the reservoir 60 passes through the valve 56 to the bottom chamber 75 of the actuator 47. This causes the arms 43 and 45 to which the actuator 47 is connected to separate to cause tilting of the car in one direction as described in connection with FIGS. 5, 6 and 7.

When the car body 13 has to be tilted in the opposite direction, the signal processor 46 is actuated to produce an electrical signal at the line 68 as well as the line 72 which is connected to a trailing truck. A typical signal at the line 68 shifts a valve 70 to permit air pressure from the reservoir or air spring 54 to pass therethrough to valve 64. The air pressure applied to the valve 64 causes it to shift permitting high pressure air from the reservoir 60 to pass therethrough into the upper chamber 74 of the actuator 47. This causes the arms 43 and 45 described in connection with FIGS. 5, 6 and 7 to come together thereby causing the car to tilt in the opposite direction to that previously described as when the valve 44 was actuated.

Depending upon whether the pressure is applied to the upper or lower chamber 74 or 75, the piston 65 will move up or down. This causes the piston rod 66 to move up or down. The distance between the ends of the lever arms 43 and 45 illustrated in FIGS. 5, 6 and 7 will become longer or shorter depending upon the application of the pressure. This extension or contraction of the actuator 47 causes tilting of the car in the manner previously described.

After the car body has tilted a predetermined angle, the degree of tilt is limited in order to stay within the clearance requirements previously referred to. These limits are provided by the limited movement of the piston 65 within the chambers 74 and 75.

Figure 12:
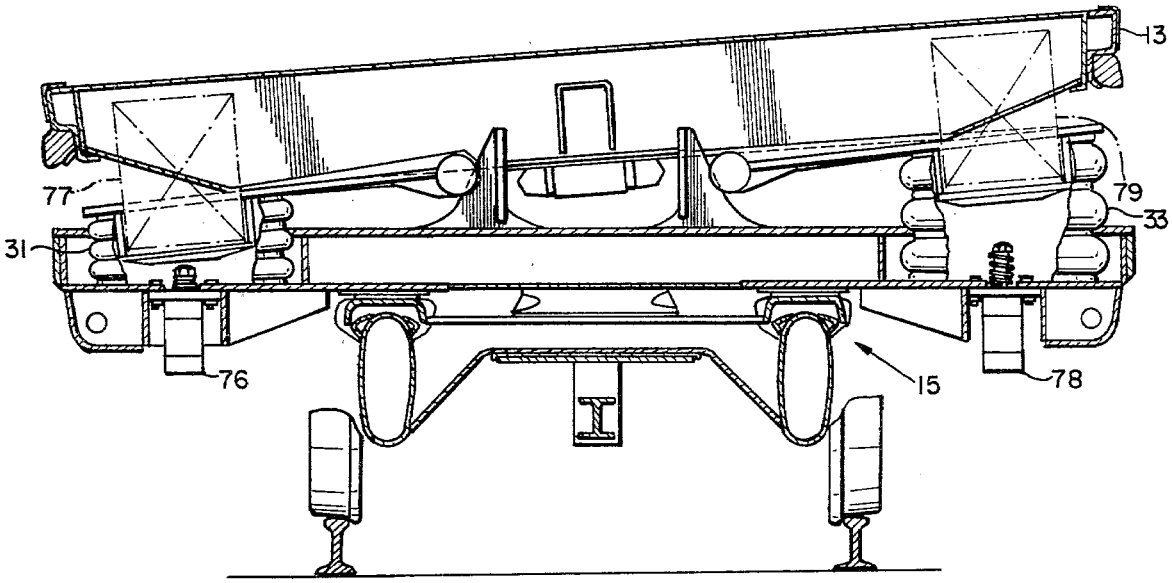
FIG. 12 is an end view of a railway car in a tilted position illustrating the operation of the stop members during a tilting operation.

A pair of stop members 76 and 78 are provided on each side of the car as also illustrated in FIG. 12. In conventional systems not involving tilting, these stop members are fixed to limit the downward movements of the car so as to prevent damage to parts beneath the car body or those carried by the truck. In order to accommodate the tilt system of the present invention, it is necessary to have the stop members moved out of the way when tilting is involved.

Oil from tanks 80 and 82 are supplied through pilot operated check valves 84 and 86 to spring loaded downstop members 76 and 78. The oil from the tanks 80 and 82 normally maintain the downstop members 76 and 78 in fixed extended positions to prevent the sides of the car body from tilting far down.

The operation of the valves 84 and 86 are controlled by air pressure from lines 88 and 90, respectively. The downstop members 76 and 78 comprise hydraulic-pneumatic members. The upper chamber is pneumatic and receives or exhausts air from line 81 and 83. The lower chamber is hydraulic. Oil from the tank 80 or 82 can always be sucked into the lower chamber through check valves 84 and 86. Oil in the lower chamber can only be expelled when the valve 84 or 86 is activated by air pressure in air line 88 or 90.

For example, when valve 56 has been shifted to pass air from reservoir 60 to chamber 75 and thereby extend cylinder 47, air also passes into the upper end of the hydraulic-pneumatic device 78 and pressurizes line 90. The pressure in line 90 causes valve 86 to shift and make it free flowing in either direction. The air pressure in the upper chamber of cylinder 78 causes the rod to retract compressing the spring and discharging oil through valve 86 into tank 82.

When the valve 56 is shifted back to exhaust chamber 75, air in the upper part of cylinder 78 is also exhausted and the valve 86 is shifted to permit free flow of oil into the cylinder but permitting no discharge. The spring extends the cylinder 78 drawing oil from the reservoir 82, as needed.

Figure 9:
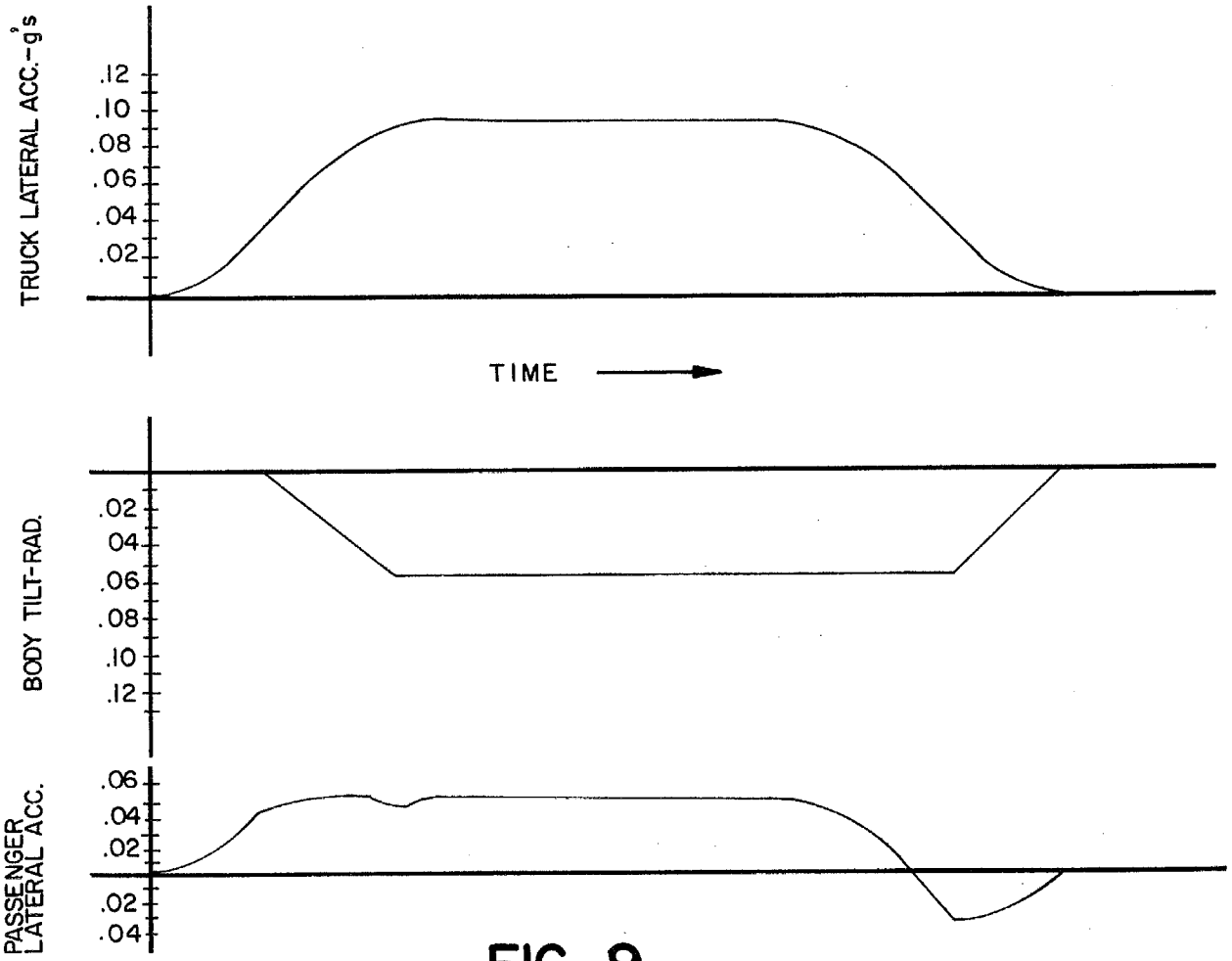
FIG. 9 is a series of curves illustrating the relationship between passenger and truck lateral acceleration forces with respect to the tilting of the car body.

As mentioned, the maximum acceptable lateral acceleration on passengers is in the order of 0.05g. The two levels at which the tilting would be triggered would begin at about 0.04g. The degree to which the passenger feels the body tilting would depend upon the speed of the actuator. Optimum actuator speed will keep the effect on the passengers to a minimum. One condition is illustrated in FIG. 9.

The curve illustrates the lateral acceleration forces of the truck under one condition where a turn in the track is encountered. It may be seen that the lateral acceleration forces may reach 0.08 g's and higher, beyond the tolerance levels of passengers.

The second curve illustrates the tilt of the car body as it becomes effective. When 0.04 g's of lateral acceleration forces are encountered, the body begins to tilt and tilts to an angle of 0.07 radians. The third curve in FIG. 1 illustrates the amount of lateral acceleration encountered by passengers under conditions illustrated by the first and second curves combined. The effects of the tilting counteracts the truck lateral acceleration forces so that the forces felt by passengers are reduced. It is noted that the lateral acceleration felt by passengers does not exceed 0.05 g's.

It is noted that in considering the lateral acceleration forces that it is assumed that a car speed, especially around turns, will conform to certain safety standards. It is apparent that if these safety standards are exceeded that the lateral acceleration forces will exceed 0.05 g's and will be felt by the passengers.

Figure 10:
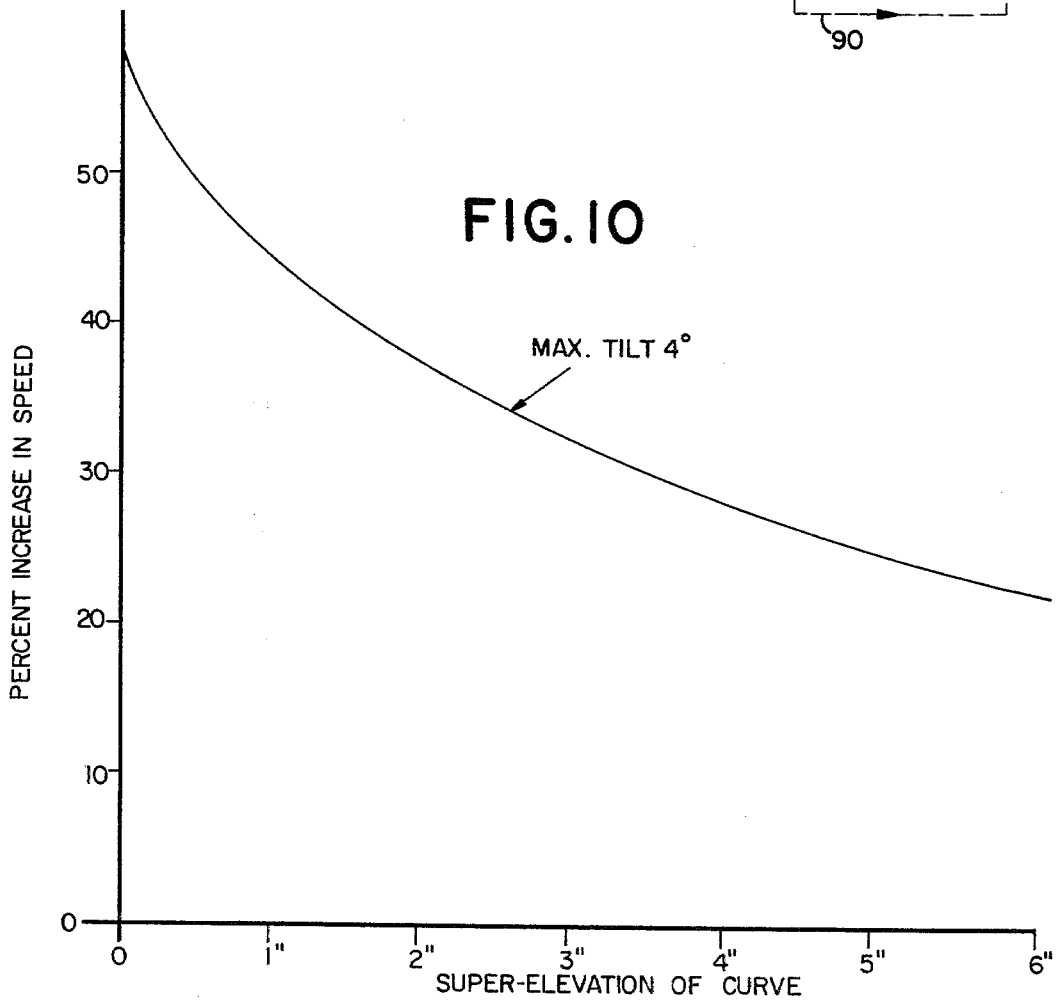
FIG. 10 is a curve illustrating a relationship between the speed of a railway car and curves.

Referring to FIG. 10, a curve is illustrated representing percent increase in speed versus superelevation in curve when maximum tilt of 4° is employed. As indicated considerable increases in speed are possible when tilting is used along with super-elevated tracks. Of course as the super elevation increases, the percentage of increase in speeds decreases because the elevation is already causing tilting to approach the desired limits.

FIG. 10 illustrates the percentage of increase in speeds at which cars may go around curves on superelevated tracks when the present invention is used, assuming a maximum tilt of 4° for the car body. As the superelevation of the tracks become greater, the percentage of increase in speed decreases. However, greatly increased speeds of almost 30 percent are possible for a superelevated tracks of 4 inches.

Figure 11:
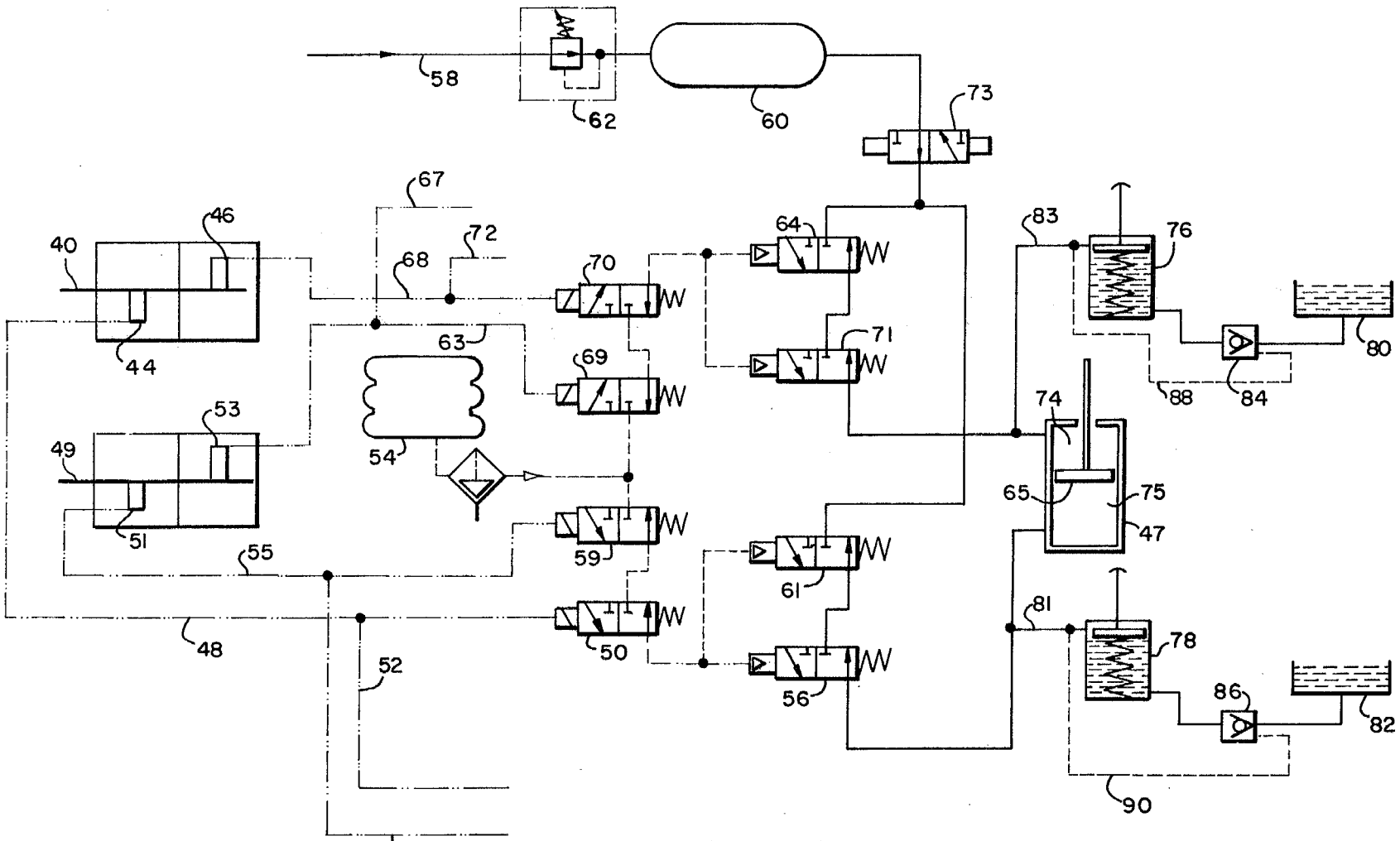
FIG. 11 is a schematic diagram somewhat similar to FIG. 8 illustrating another embodiment of the present invention.

Referring to FIG. 11, a system somewhat similar to the system of FIG. 8 is illustrated. Several components have been added in FIG. 11 to essentially eliminate the possibility of the car being tilted due to equipment failure. Basically the system of FIG. 8 which produces the tilting, has been made redundant by the addition of a similar system. Both systems must work before tilting can occur. In order to understand the functions of the additional components, the same reference numerals for similar parts which were used in FIG. 8 will be used in FIG. 11. The relationship of the added elements as they relate to the elements of FIG. 8 will be described.

Signals representing lateral acceleration forces from an accelerometer such as Model 115 of Setra Systems, Inc. Watick, Mass. or equivalent on the truck produce electrical signals which are detected and filtered and applied to a line 49 which in turn are applied to signal processors 51 and 53, which filter and produce an output signal only when acceleration forces exceed 0.04 g. At the same time, as described in connection with FIG. 8, electrical signals representing lateral acceleration are detected and filtered in processors 44 and 46 to operate subsequent devices in a manner previously described in connection with FIG. 8.

If the tilting system is operating properly, the signal processors 51 and 44 will respond to the same type of input signal at the same predetermined levels. Likewise, the signal processors 53 and 46 will respond to similar types of input signals. Dependent on the pair of signal processors 51 and 44 or 53 and 46, the car body will be tilted in one direction or the other by the application of pressurized air to the upper chamber 74 or lower chamber 75 of the actuator 47.

When the signal processor 51 is actuated, an electrical signal is developed on a line 55 which is also applied to a line 57 to a trailing truck. The signal on line 55 causes a valve 59 to close to permit air pressure from the air spring or reservoir 54 to pass therethrough. The valve 59 is in series with the valve 50, which closes when a signal at the line 48 is present. When both valves 59 and 50 are closed, the pressurized air from the air spring 54 passes therethrough to valves 59 and 50 to control valves 56 and 61.

The control valve 61 is connected in series with the control valve 56 described in FIG. 8. This arrangement assures that when one of the control valves becomes stuck in the shifted position, the other will vent the pilot signal and the actuator 47 will be vented.

When the control valves 61 and 56 are operated, pressurized air from the reservoir 60 passes through a manually controlled valve 73 and through valves 61 and 56 to the bottom chamber 75 of the actuator 47. This causes the car to tilt in one direction as illustrated in FIG. 6 or 7. The operation of subsequent elements relating to the down stop members 76 and 78 is the same as that previously described in connection with FIG. 8.

When the car body is to be tilted in the opposite direction, a signal at line 49 causes the signal processor 53 to produce an output signal on lines 63 and 67. At the same time, a signal on line 40 causes the signal processor 46 to produce an output signal on lines 68 and 72.

The signal on line 63 causes a valve 69 to close to permit air pressure from the air spring 54 to pass therethrough. The valve 69 is connected in series with the valve 70, which also closes when a signal on line 68 is developed. When both valves 69 and 70 are closed, pressurized air will pass therethrough to control valves 71 and 64.

The control valve 71 is connected in series with the control valve 64. If one of the control valves becomes stuck, the actuator 47 will still be vented upon command.

When the control valves 71 and 64 are actuated or closed, pressurized air from the reservoir 60 passes through valve 73, through control valves 71 and 64 to the upper chamber 74 of the actuator 47. This causes the car body to tilt in an opposite direction as was the case when pressurized air was applied to the lower chamber 75. The elements relating to the stop members 76 and 78 operate the same as previously described.

The system of FIG. 11 includes built in features to assure that the elements used in the tilting are operating properly before the tilting can become effective. Also, the likelihood that the system may become inoperative when the car body is tilted is minimized. This is important because a car body should normally not be tilted when tunnels or obstructions involving low clearances are encountered.

Referring to FIG. 12, a view of the car body 13 and truck 15 which may incorporate the down stop members 76 and 78 described in connection with FIGS. 8 and 11 are described. Various members illustrated in FIGS. 5, 6 and 7 are not illustrated in this view. The member 76 is illustrated in a down position to permit the left side of the car body 13 to be tilted downwardly. The member 78 is maintained in a fixed position. One of the down stop members 76 or 78 is effectively removed from the system dependent upon the direction of tilting.

During a non-tilt operation, both the down stop members 76 and 78 are fixed and they act as conventional down stop members found in many systems.

When the car is moving with no tilting, the down stop members 76 and 78 are both in fixed upper positions, such as illustrated by spring 78. The downward excursions of the car body 13 resulting from bumps, for example, are limited when bottom member of the car, such as spring mounting housings 77 and 79, physically contact the tops of the stop members 76 and 78.

Air springs 31 and 33 (as also illustrated in FIGS. 5, 6 and 7) support the car body 13. These air springs will normally operate in a conventional manner when no tilting is involved. Thus when any of the tilting members become faulty to cause the tilting operation to cease functioning, the springs 31 and 33, or other springs in the system, will restore the car body 13 to the position it normally would be in without the tilting members.

Thus it is seen that the present invention has provided a novel tilt system which includes fail safe features in case of tilting operation failures. It also provides novel down stop members capable to be used as conventional stop members and effectively removable during tilting operations. The spring arrangement assures that the car body will return to its normal position when the tilting members become defective.

The signal processors described may be conventional electronic circuitry. Such circuitry normally is biased to be non-conducting and to become conducting upon the application of an electrical signal exceeding predetermined amplitudes. Because numerous different types of bias circuits may be used, they are not shown or described in detail.

What is claimed is:

1. In combination with means for tilting a railway car body with respect to a truck in response to lateral acceleration forces, (a) means for detecting lateral acceleration forces in said railway car;

(b) an actuator included in said means for tilting for receiving forces to cause said tilting;

(c) means connected between said lateral acceleration forces and said actuator to tilt said railway car when said acceleration forces exceed predetermined levels, and (d) means for limiting the amount of tilting of said railway car.

2. The combination as set forth in claim 1 wherein said means for detecting comprises means responsive to produce electrical output signals only when said lateral acceleration forces exceed predetermined minimum levels.

3. The combination as set forth in claim 2 wherein said means for limiting is controlled by the limits of movement of said actuator.

4. The combination as set forth in claim 2 wherein a pair of normally fixed down stop mechanisms are connected to said truck to limit the downward movement of said car body in the absence of a tilting operation, at least one of said mechanisms being selectively responsive to the operation of said actuator during a tilting operation to cause said selected mechanism to move downwardly to permit said car body to be freely tilted in the direction of said selected mechanism.

5. The combination as set forth in claim 4 wherein a main source of pressurized air is provided and first valve means are connected between said main source and said actuator to selectively apply pressurized air to said actuator, and control means are connected between said means for detecting said first valve means.

6. The combination as set forth in claim 5 wherein said control means include an air spring with pressurized air, and second valve means for selectively connecting the pressurized air in said air spring to said first valve means to selectively cause the pressurized air from said main source to be applied to said actuator.

7. The combination as set forth in claim 6 wherein said actuator includes a piston providing upper and lower chambers therein, and said first valve means including first and second valves connected to said upper and lower chambers, respectively, to selectively connect pressured air to said upper or lower chamber to cause said car body to tilt in one direction or the other.

8. The combination as set forth in claim 7 wherein said first and second valves are further connected to said down stop mechanisms to selectively control the operations thereof.

9. The combination as set forth in claim 8 wherein said second valve means include third and fourth valves connected to control the operations of said first and second valves, respectively, and said electrical signals from said means for detecting to control the operations of said third and fourth valves.

10. The combination as set forth in claim 9 wherein fifth, sixth, seventh and eighth valves are connected in series with said first, second, third and fourth valves, respectively, and a second means for detecting is included to provide redundancy to prevent tilting of said car body from occurring in the event of failure of a component in the means for tilting and to assure that the car body returns to its normal position in the event of failure of said means for tilting.

* * * * *